US006866615B2

(12) United States Patent
Ryland

(10) Patent No.: US 6,866,615 B2
(45) Date of Patent: Mar. 15, 2005

(54) APPARATUS AND METHOD FOR DEVELOPING A PROPER SWIMMING WHIP KICK AND TRAINING THE COMPETITIVE BREASTSTROKER

(76) Inventor: David E. Ryland, 1708 E. Abbendale La., Sandy, UT (US) 84092

( * ) Notice: Subject to any disclaimer, the term of this patent is extended or adjusted under 35 U.S.C. 154(b) by 17 days.

(21) Appl. No.: 10/358,603

(22) Filed: Feb. 5, 2003

(65) Prior Publication Data

US 2003/0148855 A1 Aug. 7, 2003

Related U.S. Application Data

(60) Provisional application No. 60/354,570, filed on Feb. 5, 2002.

(51) Int. Cl.[7] ..... A63B 31/08
(52) U.S. Cl. ..... 482/55; 441/64
(58) Field of Search ..... 482/55–56; 441/60–64

(56) References Cited

U.S. PATENT DOCUMENTS

| | | | | | |
|---|---|---|---|---|---|
| 1,398,130 | A | | 11/1921 | Deri | |
| 1,590,484 | A | * | 6/1926 | Volker | 441/61 |
| 1,983,609 | A | | 12/1934 | Hudson | 9/21 |
| 3,671,987 | A | * | 6/1972 | Mayor | 441/61 |
| 4,310,938 | A | | 1/1982 | Eichler | 9/309 |
| 4,521,220 | A | | 6/1985 | Schoofs | 441/64 |
| 4,664,639 | A | * | 5/1987 | Schneider | 441/61 |
| 5,078,633 | A | * | 1/1992 | Tolbert, Jr. | 441/65 |
| 5,108,328 | A | | 4/1992 | Hull | 441/64 |
| 5,374,210 | A | | 12/1994 | Sardella et al. | 441/64 |

* cited by examiner

*Primary Examiner*—Stephen R. Crow
(74) *Attorney, Agent, or Firm*—Michael F. Krieger; Kirton & McConkie

(57) ABSTRACT

Apparatus and method are provided for teaching and/or improving upon the mechanics of the whip kick that may be used while performing the breaststroke and training the competitive breaststroker. The tool includes a fin that is configured to receive a swimmer's foot and a propulsive blade that engages the water at the beginning of the propulsive phase of the kick, such as when the swimmer's legs have reached maximum flexion at the knees, with feet positioned slightly wider than the knees, heels turned in while the toes are turned out and ankles flexed. As the swimmer initiates the power phase of the kick, the propulsive blade achieves maximum purchase of the water. As execution of the power phase continues, the propulsive blade channels the captured water backward and away from the swimmer, remaining stiff enough to hold onto the water while force is applied, yet sufficiently flexible enough to recover or flip downward as the swimmer extends the ankles and rolls the outer edges of his/her feet over and inward, snapping the soles together.

20 Claims, 5 Drawing Sheets

APPARATUS AND METHOD FOR DEVELOPING A PROPER SWIMMING WHIP KICK AND TRAINING THE COMPETITIVE BREASTSTROKER

RELATED APPLICATIONS

This application claims priority to provisional application Ser. No. 60/354,570, filed by David E. Ryland on Feb. 5, 2002, entitled DEVELOPING A PROPER SWIMMING WHIP KICK

BACKGROUND OF THE INVENTION

1. Field of the Invention

The present invention relates to an apparatus and method for developing a proper swimming whip kick (the type of kick required while swimming the breaststroke) and more effectively training the breaststroke swimmer. More particularly, the present invention relates to apparatus and methods that provide and utilize a teaching aid for learning and/or improving upon the mechanics of a whip kick and a training aid for strengthening the performance of competitive breaststroke swimmers.

2. Background and Related Art

Learning and developing proper mechanics and implementing stroke specific training techniques for a particular swimming stroke is important in being able to master the stroke and perform at an optimum level. For example, when the swimming stroke is the breaststroke, the learning and development of proper mechanics includes learning and developing a proper whip kick used in association with the stroke. When training to perform the breaststroke as a competitive swimmer, the use and implementation of stroke specific tools and training techniques increases stroke specific strength and heightens the associated awareness of movement related efficiencies and inefficiencies.

As for learning and developing the proper mechanics of the breaststroke whip kick . . . this can be a time consuming process. The requirements of the kick are unique and not typically intuitive. Swimmers first learning the whip kick often struggle to realize what parts or surface areas of the feet should be used for propulsion. For example, a proper whip kick requires that the tops of the feet NOT be used for propulsion, a requirement unique from all of the kicks used in all other strokes, recreational or competitive. Compounding the challenge is that the whip kick is not typically the first style of kick taught to beginning level swimmers. Typically, swimmers who begin learning the whip kick have previously learned and are able to use the more intuitive flutter and/or scissors style of kick. Both such kicks require the swimmer to use the tops of their feet to push against the water for propulsion. Thus, swimmers new to the whip kick have difficulty in conceiving and performing a kick that uses any other surface area of the foot for propulsion.

Full mechanics of the whip kick require that the heels be drawn up as closely to the buttocks as possible by flexing at the hips and knees. This action is closely followed by a lateral rotation of the feet (toes pointed outward, away from the body) and a strong flex at both ankles. From this position the swimmer must learn to initiate the propulsive phase of the kick by keeping his/her ankles flexed while engaging the water with the insides of the lower legs and feet. As the propulsive phase continues with extension of both knees and hips, an outward sweep of the feet followed by an inward sweep (or hip adduction), the swimmer must learn to ultimately roll the outside edges of the feet over and inward while extending the ankles to engage the water with the bottom surfaces of the feet snapping them together for a strong kick "finish".

But, for the reasons previously mentioned, most swimmers who initially attempt to execute a proper whip kick will draw both feet up toward their buttocks by flexing at the knees and hips, but fail to keep at least one foot laterally rotated (toes pointed outward) and ankle flexed as they initiate and follow through with the propulsive phase, thereby resulting in a "kick down" with the top of one foot or both feet. Compounding the problem is the reinforcement of forward thrust that a swimmer feels from kicking incorrectly (kicking down with the top of the foot) and the lack of such reinforcement when initially executing a correct whip kick.

A swimming teacher or coach typically uses verbal cues to convey to the swimmer the proper movement of the whip kick. For example, such verbal cues include: "Flex your ankles!" "Point your toes to the outside!" "Bring in your heels!" "Kick with the insid es of your legs and feet!" "Kick with the bottoms of your feet!" "Don't kick down!" However, such verbal cues are not typically translated well into movement by beginning level swimmers. As an added visual cue swimming teachers or coaches will typically extend their arms out to provide a visual aid, assuming the students will visualize the coach's hands as feet and the coach's elbows as knees. With the confusion and limited success that such verbal and visual cues often produce, teachers and coaches have traditionally resorted to a "hands on" approach by either entering the water with the swimmer or having the swimmer get out of the water where the teacher or coach can physically position and move the swimmers feet and legs through the correct movement pattern.

Accordingly, it would be an improvement in the art to augment or even replace current techniques to more effectively and expeditiously teach and implement the proper mechanics of the breaststroke whip kick.

As for training to perform a specific stroke such as in the case of competitive swimmers, coaches and athletes alike have traditionally sought out and implemented tools and/or methods that lend to or assist in the development of stroke specific strength and/or mechanical efficiencies. In the case of swimming fins, there are a multitude of styles on the market today to assist in the training of freestyle, butterfly and backstroke swimmers . . . strokes requiring a flutter or dolphin kick (an up and down motion of the feet using the tops of the feet to push against the water for propulsion). Swim fins for these strokes are used in training to add resistance for strength development and to allow swimmers to swim as fast or faster than "race pace" thereby allowing swimmers to feel streamlining inefficiencies. Coaches talk at length to their swimmers about the concept of streamlining or positioning to create less drag in the water. With respect to this concept, fins move swimmers through the water at a rate that allows them to more easily make the distinction between positions or movements that are streamlined and those that are not. Just as faster speed through the air is necessary to determine an objects aerodynamic quality, faster speed through the water is often necessary for a swimmer to feel the drag caused by inefficient body positioning.

However, for the breaststroker, there are currently no fins on the market today designed solely to assist in the training and strengthening of the breaststroke and associated whip kick. Accordingly, it would be an improvement in the art to have a fin or apparatus specific to the development of strength and mechanical efficiencies in the breaststroke and associated whip kick.

SUMMARY OF THE INVENTION

The present invention relates to developing a proper swimming whip kick and assisting in the training of competitive breaststroke swimmers. More particularly, the present invention relates to systems and methods that provide a teaching aid for learning and/or improving upon the mechanics of a whip kick that may be used while swimming, such as in performing the breaststroke, and a training aid for strengthening the performance of competitive breaststroke swimmers.

Implementation of the present invention takes place in association with a teaching and training tool that is used to develop a proper whip kick and a faster more efficient breaststroke. In one embodiment, the teaching/training tool includes a fin that is configured to receive a swimmer's foot which includes a propulsive blade that engages the water at the moment the swimmer laterally rotates his/her feet to "catch" the water at the beginning of the propulsive phase of the kick, such as when the swimmer's legs have reached maximum flexion at the knees, with feet positioned slightly wider than the knees, heels turned in while the toes are turned out with ankles flexed. As the swimmer initiates the power phase of the kick by pressing the feet outward and back, the propulsive blade achieves maximum purchase of the water. As execution of the power phase continues, the propulsive blade channels the "captured" water backward and away from the swimmer, remaining stiff enough to "hold" on to the water while force is applied, yet sufficiently flexible enough to recover or "flip" inward and downward as the swimmer rolls the outer edges of his/her feet over and inward and snaps the soles together.

While the methods and processes of the present invention have proven to be particularly useful in teaching a beginning level swimmer the whip kick used in association with the breaststroke, those skilled in the art will appreciate that the methods and processes can be used in a variety of different applications, including to train competitive swimmers who specialize in the breaststroke or in individual medley events. Training advantages of the present invention include but are not limited to: 1) Encourages and strengthens the swimmers ability to roll the outside edges of the feet over to push on the water with the underside or bottoms of the feet; 2) Encourages proper foot position throughout the propulsive phase of the kick; 3) Encourages a streamlined recovery of the feet, drawing the feet toward the buttocks in a relatively straight line keeping them in the "shadow" of the swimmers body as opposed to an outward sweep of the feet; 4) Encourages a strong and complete "finish" of the kick (snapping the feet together at the end of the propulsive phase of the kick); 5) Encourages and develops greater distance per kick; 6) Encourages improved streamlining during the arm reach or "glide" phase of the stroke; 7) Allows the competitive breaststroker to feel and swim at "race pace" in practice where streamlining flaws can be more easily recognized and stroke timing in and out of the turns can be addressed; 8) Develops and strengthens hip adductors, quadriceps and the gluteus. 9) Encourages "faster feet" during the propulsion phase of the kick.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

The present invention relates to developing a proper swimming whip kick and assisting in the training of breaststroke swimmers. More particularly, the present invention relates to apparatus and methods that provide and utilize a teaching aid for learning and/or improving upon the mechanics of a whip kick that may be used while swimming, such as in performing the breaststroke, and a training aid for strengthening the performance of competitive breaststroke swimmers.

Embodiments of the present invention take place in association with a teaching and training tool that is used to develop a proper whip kick and a faster more efficient breaststroke. In one embodiment, the teaching/training tool includes a fin that is configured to receive a swimmer's foot which includes a propulsive blade that engages the water at the moment the swimmer laterally rotates his/her foot to "catch" the water at the beginning of the propulsive phase of the kick, such as when the swimmer's legs have reached maximum flexion at the knees, with feet positioned slightly wider than the knees, heels turned in while the toes are turned out with ankles flexed. As the swimmer initiates the power phase of the kick by pressing the feet outward and back, the propulsive blade achieves maximum purchase of the water. As execution of the power phase continues, the propulsive blade channels the "captured" water backward or away from the swimmer, remaining stiff enough to "hold" on to the water while force is applied, yet sufficiently flexible enough to recover or "flip" inward and downward as the swimmer rolls the outer edges of his/her feet over and inward and snaps the soles together. Traditional techniques include a fin with a rigid non flexible blade that will not load and recover to produce the desired propulsion.

Figure 1:
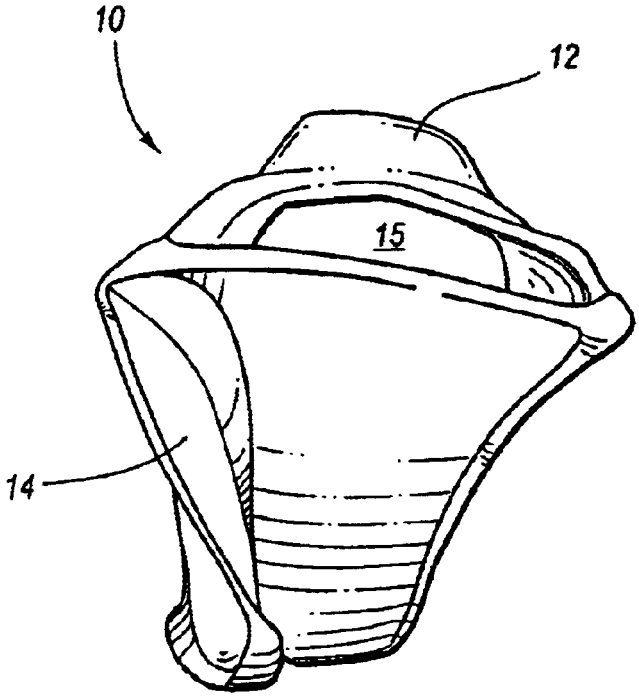
FIG. 1 illustrates a perspective frontal view of a representative embodiment that may be used in accordance with the present invention to develop a proper whip kick.

With reference now to FIG. 1, a representative embodiment of the present invention is illustrated as fin 10, which includes shoe 12, which is configured to receive a swimmer's foot, and blade 14, which is configured to engage the water at the moment the swimmer flexes at the ankles and laterally rotates the feet. In the illustrated embodiment, fin 10 comprises a rubber material, however other embodiments of the present invention embrace fins that comprise a polymer or other material that is flexible.

In FIG. 1, shoe 12 receives the entire foot of a swimmer and allows the toes to extend from an aperture 15. Those skilled in the art will appreciate that other embodiments embrace other configurations of a shoe, such as one that includes one or more straps that extend around the back of the foot and/or over the top of the foot.

Blade 14 is a flexible propulsive blade that comprises a rubber and/or polymer material, and extends downward from the outer edge and along the complete length of the shoe 12. Thus, fin 10 is configured to receive a right foot of the swimmer. A mirror image of fin 10 would be used on the left foot of the swimmer. The shape and angle, relative to shoe 12, of blade 14 enable a downward extension of the blade 12 that graduates or increases (fans) from the outer edge of the heel to the outer edge of the swimmer's small toe. Further, in the illustrated embodiment, the general thickness of the main body or surface area of the blade 14 tapers from approximately $3/16^{th}$ or $1/4^{th}$ of an inch at the heel towards zero at the toe. Those skilled in the art will appreciate that the present invention embraces blades that are thicker, thinner, stiffer or more flexible than the illustrated embodiment.

Figure 2:
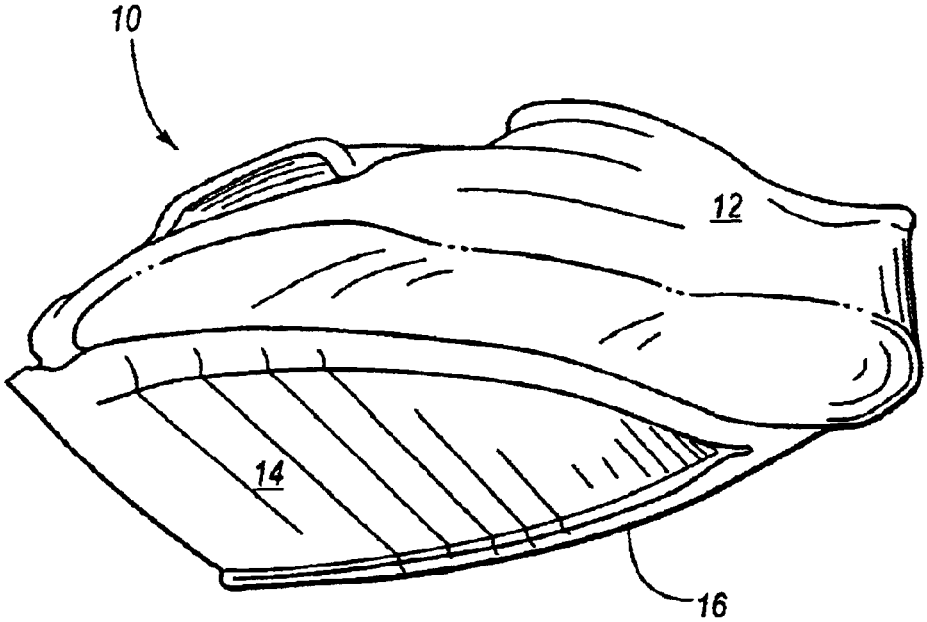
FIG. 2 illustrates an elevational view of the embodiment of FIG. 1.

With reference to FIG. 2, the bottom edge of blade 14 is reinforced with a hard or stiff rubber rail 16 that tapers from a width of approximately ½ inch at the heel towards zero at the toe. In the illustrated embodiment, blade 14 angles inwardly from the heel to the toe and toward the center of the foot from the outer edge of the shoe 12. In one embodiment, blade 14 angles inwardly with respect to shoe 12 at one of a variety of acute angles, such as an angle within the range of 40° to 70°. Those skilled in the art will appreciate that embodiments of the present invention embrace the use of other angles outside of the range of 40° to 70°. Blade 14 and shoe 12 are comprised of a single piece with no hinges or otherwise moving parts. Blade 14 ranges from 2" to more than 4" at its widest point. In some embodiments, blade 14 begins with a width of approximately 2" near the position of a little toe of a foot inserted into the opening to a width of approximately 4" at the widest point and then tapering down to near zero at the heel area.

In one embodiment, an instructor inserts his/her hands into shoe 12 of fin 10 and extends his/her arms to provide a visual aid as a teaching tool for the student. As such, there is a greater likelihood that the instructor's arms will be understood as the swimmer's legs. As the instructor moves his arms through the motion of a whip kick and the student visually tracks the propulsive blades, it becomes much more easily and quickly understood which surface areas of the feet should provide propulsion and how the feet must be positioned to achieve the desired results.

Swimmers first learning the whip kick, often struggle to realize the parts or surface areas of their feet that should be used to push against the water for propulsion. The whip kick is not typically the first style of kick taught to beginning level swimmers and it is not typically an intuitively understood movement by new swimmers. Typically, swimmers who begin learning the whip kick have previously learned and are able to use a flutter and/or scissors kick. Both such kicks require the swimmer to use the tops of their feet to push against the water for propulsion. Thus, new swimmers have a difficulty in conceiving and performing a kick that uses any other surface area of the foot for propulsion. As a result, most swimmers who initially attempt to execute a proper whip kick, will draw both feet up toward their body by flexing at the knees and hips, sweep their feet in a circular motion while extending and adducting the legs, but fail to keep at least one foot laterally rotated (toes pointed outward) and ankle flexed during the initial propulsive phase, thereby resulting in a "kick down" with the top of one foot or both feet.

It is time consuming for the swimmer to be "talked" through the correct mechanics of a whip kick. Embodiments of the present invention facilitate the learning process by providing a uniquely shaped and positioned propulsive blade 14 that not only provides a visual teaching tool as to how the foot should move through the water for propulsion during the whip kick, but also a very significant kinesthetic or tactile teaching tool as the student uses fin 10 while swimming.

Blade 14 provides a significant feeling of pressure and traction when the legs and feet are positioned correctly during the propulsive phase of the whip kick. The thrust forward is immediate and the swimmer is positively reinforced for proper execution of the mechanics of the whip kick. Further, the receipt of such positive reinforcement yields a tendency to subsequently repeat the correct movement pattern. As such, the required investment of time to teach or learn the whip kick is typically reduced.

Figure 10:
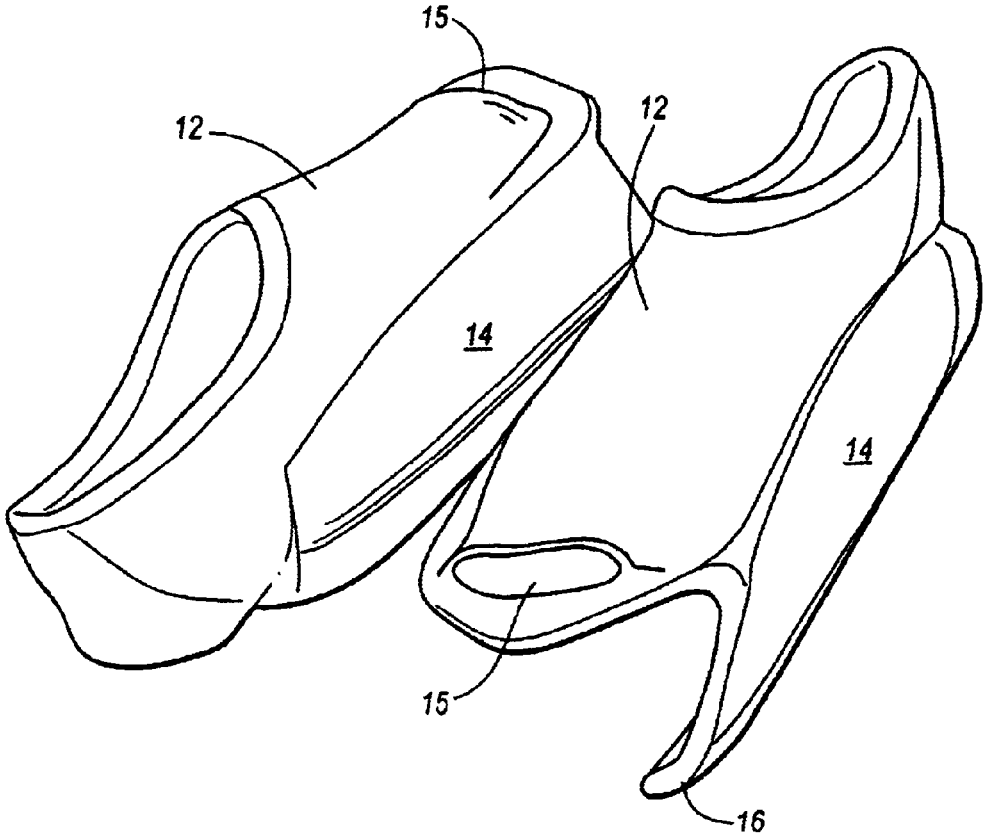
FIG. 10 illustrates an embodiment from several views.

FIG. 10 produces very little propulsion when the swimmer kicks down or pushes against the water incorrectly (i.e. with the tops of his/her foot). Alternatively, a mechanically accurate execution of the kick (i.e. holding a lateral rotation of the foot with flexed ankle while extending and adducting the legs) will produce a significant thrust forward for the swimmer. Thus, use of fin 10 while swimming provides an awareness of feeling a weight, pressure or traction when the whip kick is executed properly.

Traditional techniques include a fin that extends beyond the end of the swimmers toes that provides significant propulsion when the swimmer kicks down with the tops of the feet. This reinforces an incorrect kick.

For swimmers who have already learned the breaststroke whip kick, many use only the surfaces on the inside of their feet and lower legs to transfer power to the water when performing a breaststroke. However, the power of the kick is enhanced when the outside edges of the feet are rolled over and inward, thereby exposing the underside or bottoms of the feet, thus increasing the usable surface area of the feet for propulsion. Blade 14 of fin 10 significantly encourages, enhances and reinforces this movement.

Another typical weakness among even the more accomplished swimmers is a lack of foot speed during the recovery phase of the whip kick (that part of the kick cycle when the knees and hips flex to draw the feet up for the initiation of the propulsive phase). Proper mechanics during the recovery include drawing the heels up toward the hips with maximum speed followed by a rotation of the feet outward with ankles flexed to initiate the propulsive phase. To accomplish the increased heel speed during recovery, they are kept inside the body's "shadow" or directly behind the hips. Many swimmers begin sweeping or reaching outward with their feet during the recovery, thereby creating unwanted resistance to forward movement. Embodiments of the present invention reinforce the proper heel path and speed during recovery by increasing the resistance felt by the swimmer implementing an outward sweep of the feet. Traditional techniques include hinged flaps or blades that retract or lay down during an outward sweep of the feet, thereby sending no signals to the swimmer that their recovery could be faster and more streamlined if their feet were to take a straighter path as they are drawn toward the body. Traditional techniques also include a fin that extends beyond the end of the swimmers toes that inhibit a quick transition from kick recovery to propulsive phase.

Embodiments of the present invention further teach and encourage a swimmer to "finish" their kick. A great swimmer continues to extend and adduct his/her legs during the whip kick until the feet snap together, as if trying to squeeze all the water out from between them. The propulsive blade of the current invention provides such substantial traction that the swimmer is strongly encouraged to continue pressing until the feet come together, thereby increasing the overall efficiency and distance achieved by each kick.

Moreover, embodiments of the present invention contribute to the development of a safer kick. While the flutter and dolphin kicks are very safe movements no matter how much effort is applied, the whip kick can result in undue strain or injury to the knee. For example, there exist two main components of the whip kick power phase, namely a leg adduction (i.e. squeezing the legs together) and a leg extension (i.e. straightening the legs). Many swimmers place more emphases on the adduction component than they do on the extension component. This misplaced emphasis may lead to medial knee injuries and may place undue strain on the groin muscles. To prevent this problem, a swimmer learns to place less emphasis on the adduction component and more emphasis on the extension component. Embodiments of the present invention helps develop a safer kick by delivering better results, such as more propulsion, when emphasis is placed on the extension component of the legs resulting in a straighter path taken by the feet on the kick back.

Due to the added resistance provided by the propulsive blade 14, a swimmer is more likely to feel the limitations of the knee and groin areas early when executing the power phase of the kick. This encourages less of an outward sweep of the feet during the kick, which requires less emphasis on leg adduction and increased emphasis on leg extension. As such, the swimmer is thus led to keep his/her feet in a safer zone during the power phase of the kick. Embodiments of the present invention further increase the strength of the specific muscle groups that are used to execute the power phase of the whip kick. Positive adaptations occur in the hip adductors, gluteus and quadriceps.

Thus, as disclosed herein, embodiments of the present invention facilitate a proper and stronger whip kick. The propulsive blade 14 positions to engage the water or load at the moment a swimmer laterally rotates his/her feet with flexed ankles to catch the water at the beginning of the propulsive phase of the kick. As the swimmer initiates the power phase of the kick, the propulsive blade 14 achieves maximum purchase of the water. The propulsive blade channels the "captured" water backward, remaining stiff enough to "hold" on to the water while force is applied, yet sufficiently flexible enough to recover or "flip" downward as the swimmer rolls the outer edges of his/her feet over and inward, extends the ankles and snaps the soles together.

Figure 3:
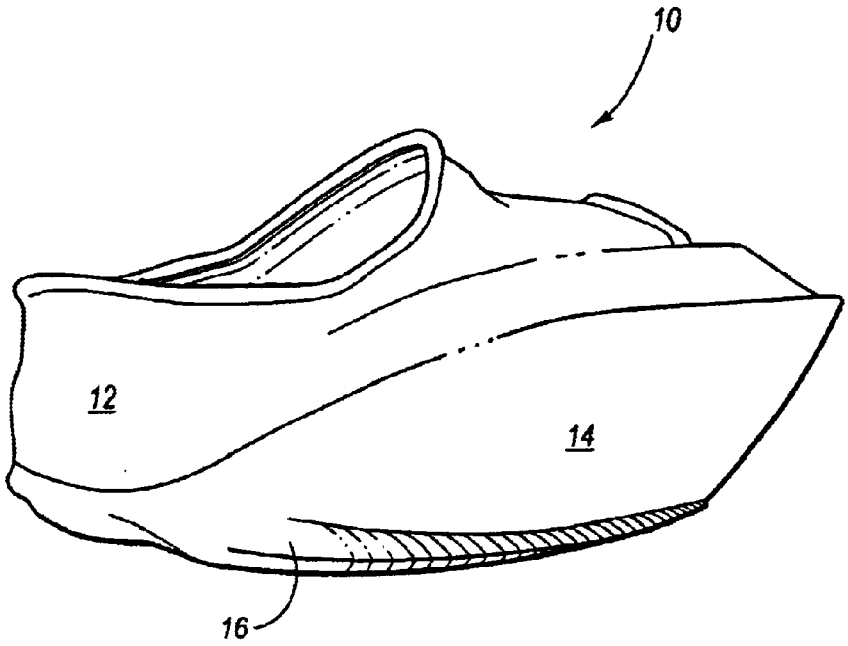
FIG. 3 illustrates a second elevational view of the embodiment of FIG. 1.
Figure 4:
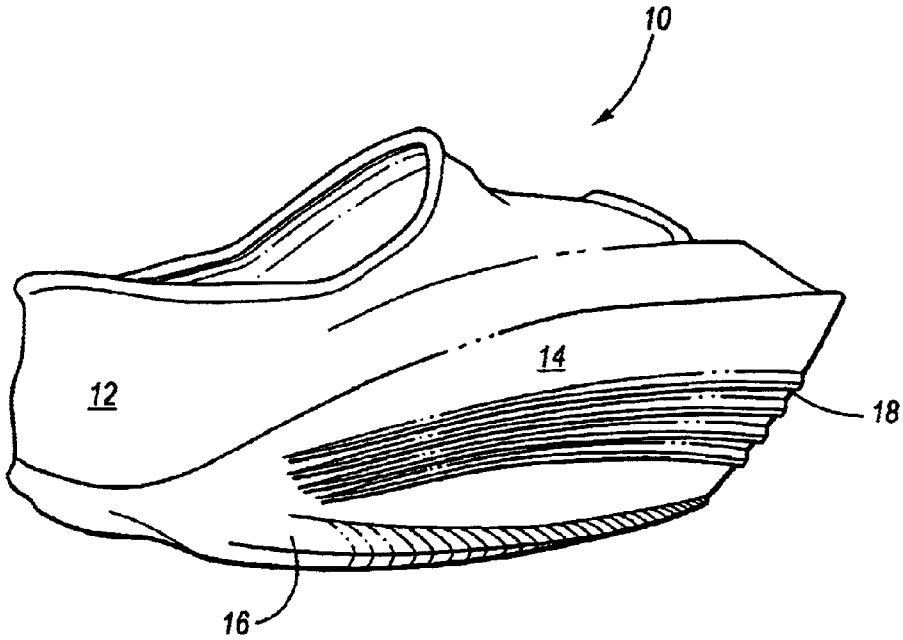
FIG. 4 illustrates another representative embodiment of the present invention that includes ribs extending down the length of the blade.

With reference to FIGS. 3 and 4, a side view is provided of fin 10. In FIG. 4, one or more ribs 18 are provided on blade 14 to enhance the stiffness, strength and/or the resistive nature of blade 14. In accordance with embodiments of the present invention, the stiffness of the blade may correspond to the strength of the swimmer. Embodiments of the present invention embrace providing one or more ribs on the inside and/or outside surface of blade 14.

In the illustrated embodiments, blade 14 is flexible and is angled inwardly. In a further embodiment, the blade 14 and shoe 12 are one solid piece of material. A stabilizing and water-channeling rail 16 is located on a bottom edge of blade 14. Rail 16 provides an amount of stiffness to an otherwise overly flimsy blade and enables the water to be captured or channeled in a manner that is effective for the swimmer.

The use of fin 10 does not impede the natural rhythm of the swimmer's kick, particularly with respect to the recovery of the whip kick at the instant when the swimmer's ankles flex and the feet laterally rotate. As such, in at least one embodiment, the length of shoe 12 corresponds to the length of the swimmer's foot with no propulsive blade extending beyond the toes that provides propulsion if the swimmer where to kick down on the water with the tops of the feet. Fin 10 and blade 14 encourage proper roll over of the outside edges of the feet at the end of the propulsive phase of the kick. Fin 10 also encourages proper heel recovery in the shadow of the swimmer's body. Further it encourages use of the bottom surface of a swimmer's feet for propulsion while executing the whip kick. Thus, fin 10 encourages proper leg and foot positioning during the recovery and throughout the propulsive phase of the kick.

As such, implementation of the embodiments of the present invention provides a decrease in the instruction time required to teach the proper mechanics for a whip kick; eliminates the presence of a "floppy ankle" (i.e. an ankle that does not hold a flexed position during the initiation of the propulsive phase of the kick, inadvertently extending to allow a kick down using the top of the foot for propulsion); encourages a lateral rotation of the feet with flexed ankles; encourages and develops ability to roll the outside edges of the feet over and inward to push on the water with the underside or bottoms of the feet; and promotes a streamlined heel recovery in the shadow of the body as opposed to an outward sweep of the feet. A propulsive blade provides increased resistance (water pressure) and heightens the swimmers "feel" of the water necessary to maintain proper foot position when performing the whip kick. In at least one embodiment of the present invention, the resistance is continuous. Implementation of the embodiments of the present invention further promotes a strong and complete finish to the kick, more distance per kick, a safer kick by encouraging emphasis on the leg extension component of the power phase of the kick over the adduction component, a more effective streamlining technique during the "arm reach" or glide phase of the breaststroke and develops increased strength of the hip adductors, quadriceps, and gluteus. Embodiments of the present invention assist both competitive and recreational swimmers, swimming instructors and swimming coaches.

Figure 5:
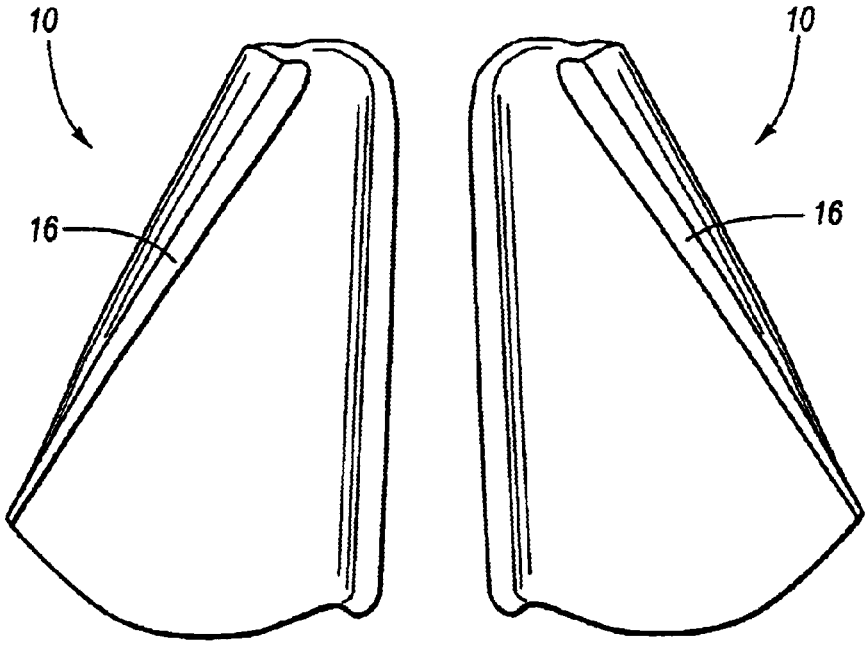
FIG. 5 illustrates a bottom view of a third representative embodiment of the present invention.
Figure 6:
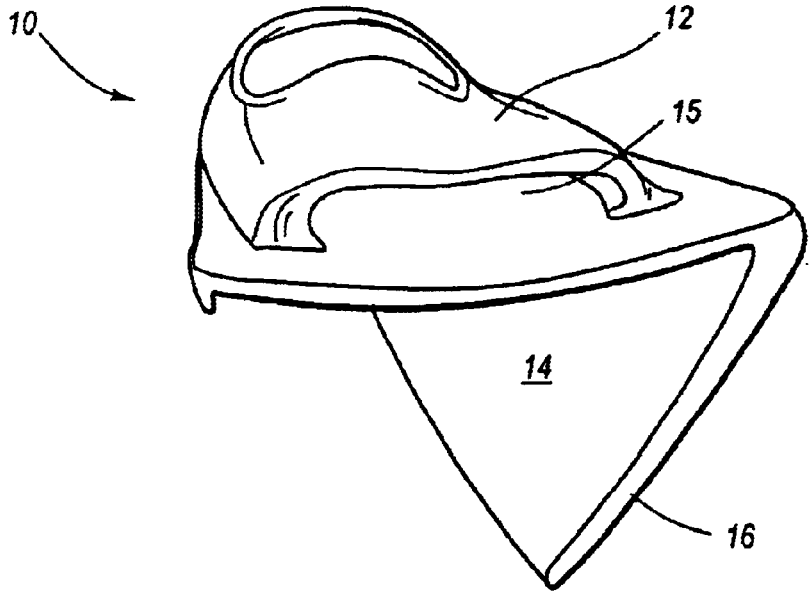
FIG. 6 illustrates a fourth representative embodiment of the present invention.
Figure 7:
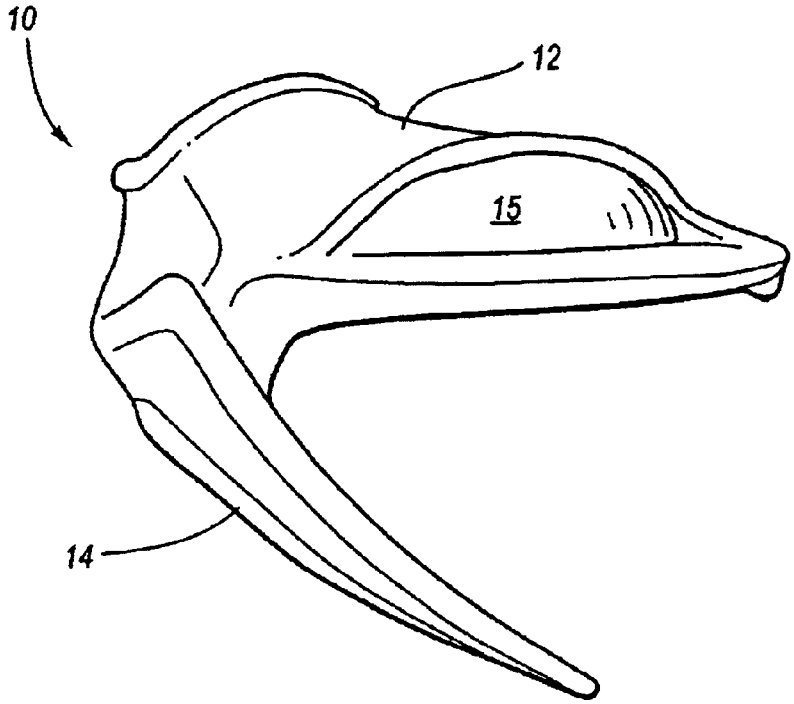
FIG. 7 illustrates an elevational view of the embodiment of FIG. 6.
Figure 8:
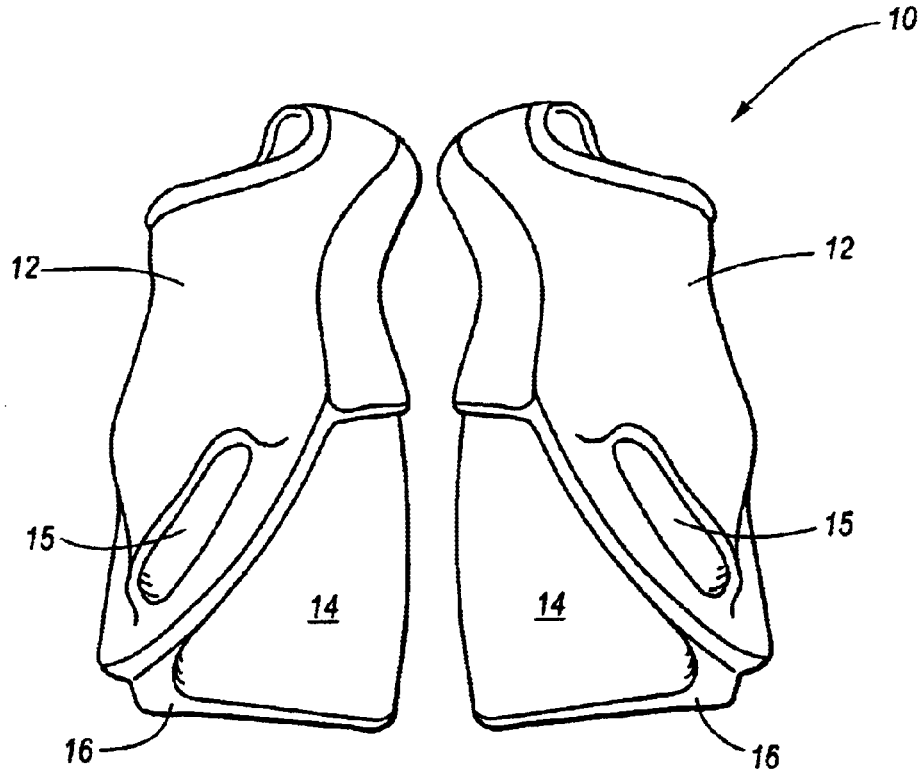
FIG. 8 illustrates a plan view of the embodiment of FIG. 6.
Figure 9:
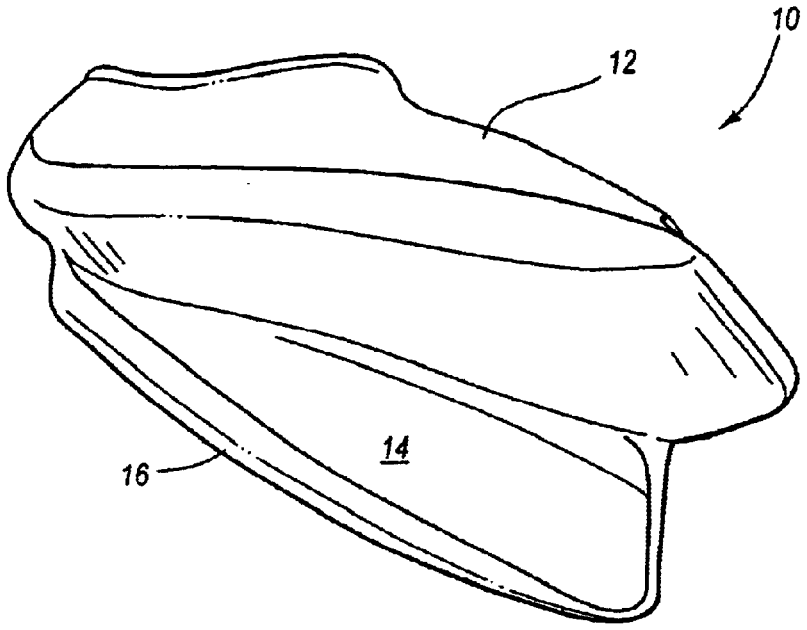
FIG. 9 illustrates an elevational view of the embodiment of FIG. 6.

With reference now to FIGS. 5–9, additional embodiments of the present invention are provided. FIG. 5 illustrates a bottom view of a third representative embodiment of the present invention. FIGS. 6–9 illustrate a fourth representative embodiment of the present invention, wherein FIG. 6 is a frontal view, FIG. 7 is another frontal view, FIG. 8 is a top perspective view, and FIG. 9 is a side view.

Thus, as discussed herein, the embodiments of the present invention relate to developing a proper swimming whip kick and assisting in the training of the competitive breaststroke swimmer. More particularly, embodiments of the present invention embrace systems and methods that provide a teaching aid for learning and/or improving upon the mechanics of a whip kick that may be used while swimming, such as in performing the breaststroke and a training aid for strengthening the performance of competitive breaststroke swimmers.

FIG. 10 illustrates various views of one embodiment of the present invention.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. An apparatus used in association with developing a proper swimming whip kick and training the competitive breaststroker, the apparatus comprising:

a shoe configured to receive at least a portion of a user's foot, wherein the shoe includes a heel end and a toe end;

an inwardly angled propulsive blade formed with the shoe, wherein the blade and the shoe form an acute angle, wherein the blade corresponds to the length of the shoe from the heel end to the toe end, wherein the blade fans forward from the outside edge of the heel end to the outside edge of the toe end, and wherein no portion of the propulsive blade extends beyond the heel end or the toe end of the shoe; and a water-channeling rail formed to the bottom edge of the blade to enhance stiffness of the blade.

2. An apparatus as recited in claim 1, wherein the blade is flexible.

3. An apparatus as recited in claim 1, wherein the shoe and the blade comprise at least one of:

a rubber material; and a polymer material.

4. An apparatus as recited in claim 1, wherein the blade is varied in stiffness relative to a size of the shoe.

5. An apparatus as recited in claim 4, wherein the propulsive blade includes one or more ribs.

6. An apparatus as recited in claim 5, wherein the one or more ribs enhance at least one of (i) stiffness, (ii) strength, and (iii) a resistive nature of the blade.

7. An apparatus as recited in claim 6, wherein the stiffness of the blade corresponds to the strength of the user.

8. An apparatus as recited in claim 5, wherein the one or more ribs are formed on once of (i) an inside surface of the blade and (ii) an outside surface of the blade.

9. An apparatus as recited in claim 1, wherein the acute angle is varied relative to the size of the shoe.

10. An apparatus used as a teaching aid for strengthening the performance of a competitive breaststroke swimmer, the apparatus comprising:

a shoe configured to receive at least a portion of the breaststroke swimmer's foot, wherein the shoe includes a heel end and a toe end; and an inwardly angled propulsive blade formed with the shoe, wherein the blade and the shoe form an acute angle, wherein the blade corresponds to the length of the shoe from the heel end to the toe end, wherein the blade fans forward from the outside edge of the heel end to the outside edge of the toe end, and wherein no portion of the propulsive blade extends beyond the heel end of the shoe.

11. An apparatus as recited in claim 10, wherein no portion of the propulsive blade extends beyond the toe end of the shoe.

12. An apparatus as recited in claim 10, wherein the shoe comprises at least one of (i) a rubber material, and (ii) a polymer material.

13. An apparatus as recited in claim 10, wherein the blade comprises at least one of (i) a rubber material, and (ii) a polymer material.

14. An apparatus as recited in claim 10, wherein the propulsive blade includes one or more ribs.

15. An apparatus as recited in claim 14, wherein the one or more ribs enhance at least one of (i) stiffness, (ii) strength, and (iii) a resistive nature of the blade.

16. An apparatus as recited in claim 14, wherein the one or more ribs are formed on once of (i) an inside surface of the blade, and (ii) an outside surface of the blade.

17. An apparatus as recited in claim 10, wherein a stiffness of the blade corresponds to the strength of the user.

18. An apparatus used as a teaching aid for strengthening the performance of a competitive breaststroke swimmer, the apparatus comprising:

a shoe configured to receive at least a portion of the breaststroke swimmer's foot, wherein the shoe includes a heel end and a toe end; and an inwardly angled propulsive blade formed with the shoe such that the propulsive blade corresponds to the length of the shoe from an outside edge of the heel end to the toe end of the shoe, the blade and the shoe forming an acute angle, and wherein the blade fans forward from a heel end of the blade to a toe end of the blade and a stiffness of the propulsive blade decreases from the heel end of the blade to the toe end of the blade.

19. An apparatus as recited in claim 18, further comprising a water-channeling rail formed to a bottom edge of the blade to enhance the stiffness of the blade, and wherein a thickness of the propulsive blade and water channeling rail decreases from the heel end to the toe end.

20. An apparatus as recited in claim 19, wherein the propulsive blade enables the swimmer to at least one of (i) propel water from a sole of the shoe in a heel to toe direction, and (ii) perform a rapid and mechanically correct heel recovery.

* * * * *